US011084154B2

(12) United States Patent
Chou

(10) Patent No.: US 11,084,154 B2
(45) Date of Patent: Aug. 10, 2021

(54) SPARE MAGAZINE AND STAPLER HAVING THE SAME

(71) Applicant: PAO SHEN ENTERPRISES CO., LTD., Chang Hua (TW)

(72) Inventor: Chun-Pin Chou, Chang Hua (TW)

(73) Assignee: PAO SHEN ENTERPRISES CO., LTD., Chang Hua (TW)

( * ) Notice: Subject to any disclaimer, the term of this patent is extended or adjusted under 35 U.S.C. 154(b) by 40 days.

(21) Appl. No.: 16/751,396

(22) Filed: Jan. 24, 2020

(65) Prior Publication Data

US 2021/0107127 A1 Apr. 15, 2021

(30) Foreign Application Priority Data

Oct. 9, 2019 (TW) ..... 108136659

(51) Int. Cl.
*B25C 5/16* (2006.01)
*B25C 5/02* (2006.01)

(52) U.S. Cl.
CPC ..... *B25C 5/1679* (2013.01); *B25C 5/025* (2013.01); *B25C 5/1696* (2013.01)

(58) Field of Classification Search
CPC ..... B25C 5/1679; B25C 5/25; B25C 5/1696; B25C 5/16; B25C 5/02
USPC ..... 227/120
See application file for complete search history.

(56) References Cited

U.S. PATENT DOCUMENTS 5,690,268 A * 11/1997 Evans ..... B25C 5/025 227/120
6,062,456 A * 5/2000 Patti ..... B25C 5/025 227/134
2004/0040999 A1* 3/2004 Ackeret ..... B25C 5/0214 227/63
2012/0018486 A1* 1/2012 Chen ..... B25C 5/11 227/120

* cited by examiner

*Primary Examiner* — Andrew W Tecco
*Assistant Examiner* — Luis G Del Valle

(57) ABSTRACT

A spare magazine is adapted to be installed in a stapler, and includes a casing unit, a pivot member and a sliding carrier. The pivot member is pivotally disposed in the casing unit, and has a positioning pin. The sliding carrier has a carrier body slidably received in the casing unit, and a main track portion protruding from the carrier body, and having an island block and a surrounding wall that cooperatively define a main track. The sliding carrier is slidable relative to the casing unit between a closed position and a first open position. The positioning pin of the pivot member is inserted into the main track and is slidable in the main track along a heart-shaped route during the sliding movement of the sliding carrier.

10 Claims, 16 Drawing Sheets

SPARE MAGAZINE AND STAPLER HAVING THE SAME

CROSS-REFERENCE TO RELATED APPLICATION

This application claims priority of Taiwanese Patent Application No. 108136659, filed on Oct. 9, 2019.

FIELD

The disclosure relates to a stapler, and more particularly to a spare magazine for storing spare staples, and a stapler having the spare magazine.

BACKGROUND

A conventional stapler includes a staple magazine that can only accommodate two rows of staples at most. In the case of heavy use, a user needs to spend a great amount of time looking for spare staples to refill the stapler, which is quite inconvenient.

SUMMARY

Therefore, the object of the disclosure is to provide a spare magazine and a stapler having the same that can alleviate the drawback of the prior art.

According to a first aspect of the disclosure, a spare magazine is adapted to be installed in a stapler and is adapted for storing a plurality of spare staples. The spare magazine includes a casing unit, a pivot member and a sliding carrier.

The casing unit defines a receiving space and a pivot space that extends in a height direction from an end of the receiving space. The casing unit has a casing opening that is directly and spatially communicated with the receiving space and the pivot space.

The pivot member is pivotally disposed in the pivot space of the casing unit, and has a pivot end and a positioning pin. The pivot end is connected to the casing unit, and serves as a pivot of the pivot member. The positioning pin is distal from the pivot end, and extends into the receiving space of the casing unit.

The sliding carrier has a carrier body and a main track portion.

The carrier body is slidably received in the receiving space of the casing unit, defines a storage space for storing the spare staples, and has a push end being exposed at the casing opening of the casing unit for access to a user.

The main track portion protrudes from the carrier body in the height direction, and has an island block and a surrounding wall.

The island block has a concave end and a tapered end that are respectively proximate to and distal from the push end of the carrier body. The surrounding wall surrounds and is spaced apart from the island block, has a protruding guide end that is proximate to and protrudes toward the concave end of the island block, and cooperates with the island block to define a main track therebetween. The positioning pin of the pivot member is inserted into the main track and is slidable in the main track along a heart-shaped route.

The sliding carrier is slidable parallel to a length direction which is perpendicular to the height direction relative to the casing unit between a closed position and a first open position. The positioning pin is slidable in the main track along the heart-shaped route during the sliding movement of the sliding carrier in the length direction.

When the sliding carrier is at the closed position, the push end of the sliding carrier is disposed at the casing opening of the casing unit such that the storage space of the sliding carrier is enclosed in the casing unit, the positioning pin is proximate to the protruding guide end of the surrounding wall and abuts against the concave end of the island block, and an imaginary plane extending through a geometric center line of the positioning pin which extends in the height direction and being perpendicular to the length direction intersects a first plane extending through the protruding guide end and being perpendicular to a width direction which is perpendicular to the height direction and the length direction at an intersection which does not overlap the geometric centerline of the positioning pin.

When the sliding carrier is at the first open position, the push end of the sliding carrier is disposed outside of the casing opening of the casing unit such that the storage space is exposed to the external environment, the positioning pin is proximate to the tapered end of the island block, and another imaginary plane extending through the geometric center line of the positioning pin and being perpendicular to the length direction intersects a second plane extending through the tapered end and being perpendicular to the width direction at an intersection which does not overlap the geometric centerline of the positioning pin.

According to a second aspect of the disclosure, a stapler is adapted for storing and hammering a plurality of staples and is adapted for storing a plurality of spare staples. The stapler includes a main unit, a primary magazine and at least one of the abovementioned spare magazine.

The main unit includes a first main body, a second main body that is connected pivotally to the first main body, and a hammer that is mounted to the first main body for hammering the staples.

The primary magazine is mounted in the first main body of the main unit, is adapted for storing the staples, and has a hammering opening that faces the second main body of the main unit. The hammer is operable to extend through the hammering opening.

The at least one spare magazine is movably installed in the main unit.

BRIEF DESCRIPTION OF THE DRAWINGS

Other features and advantages of the disclosure will become apparent in the following detailed description of the embodiments with reference to the accompanying drawings, of which.

DETAILED DESCRIPTION

Figure 1:
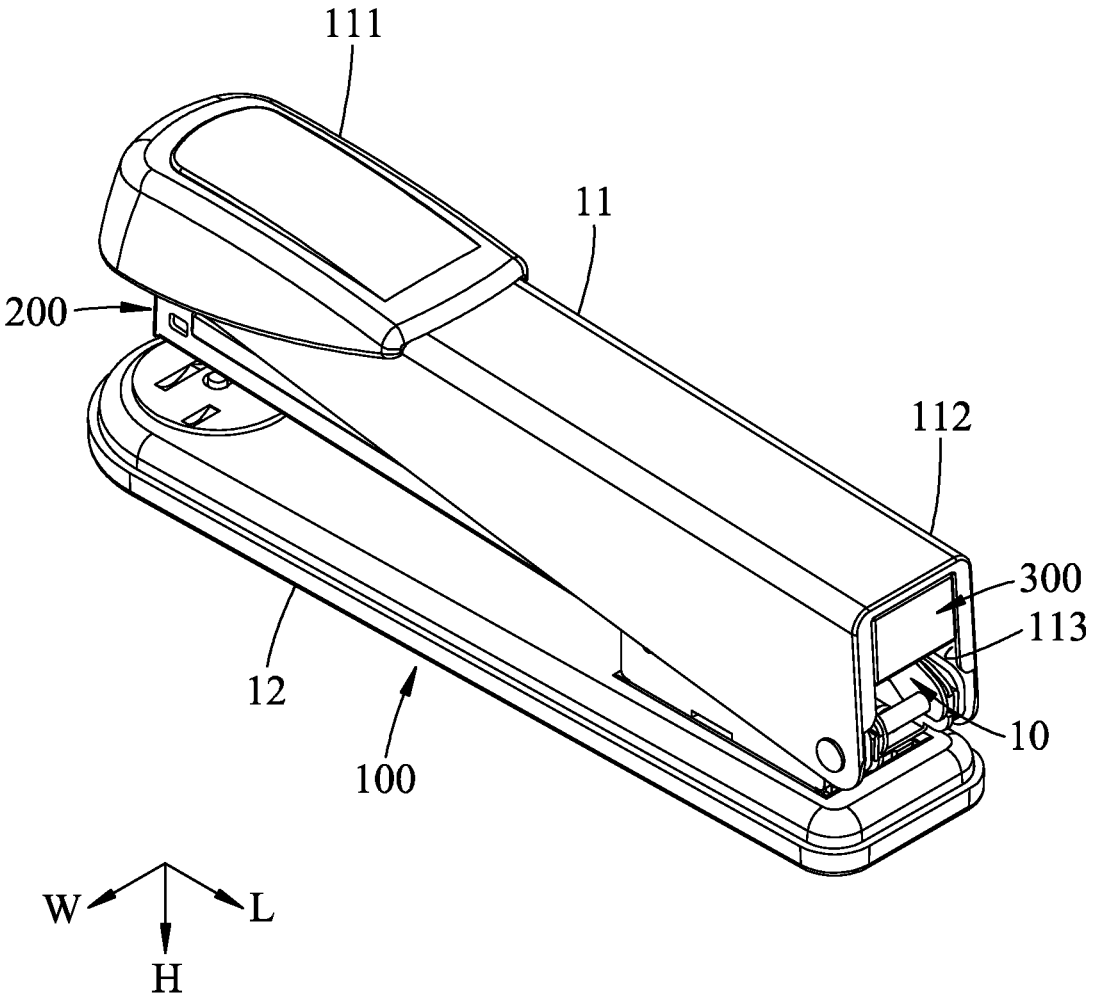
FIG. 1 is a perspective view of a first embodiment of a stapler according to the disclosure.

Before the present disclosure is described in greater detail, it should be noted that where considered appropriate, reference numerals or terminal portions of reference numerals have been repeated among the figures to indicate corresponding or analogous elements, which may optionally have similar characteristics.

Figure 2:
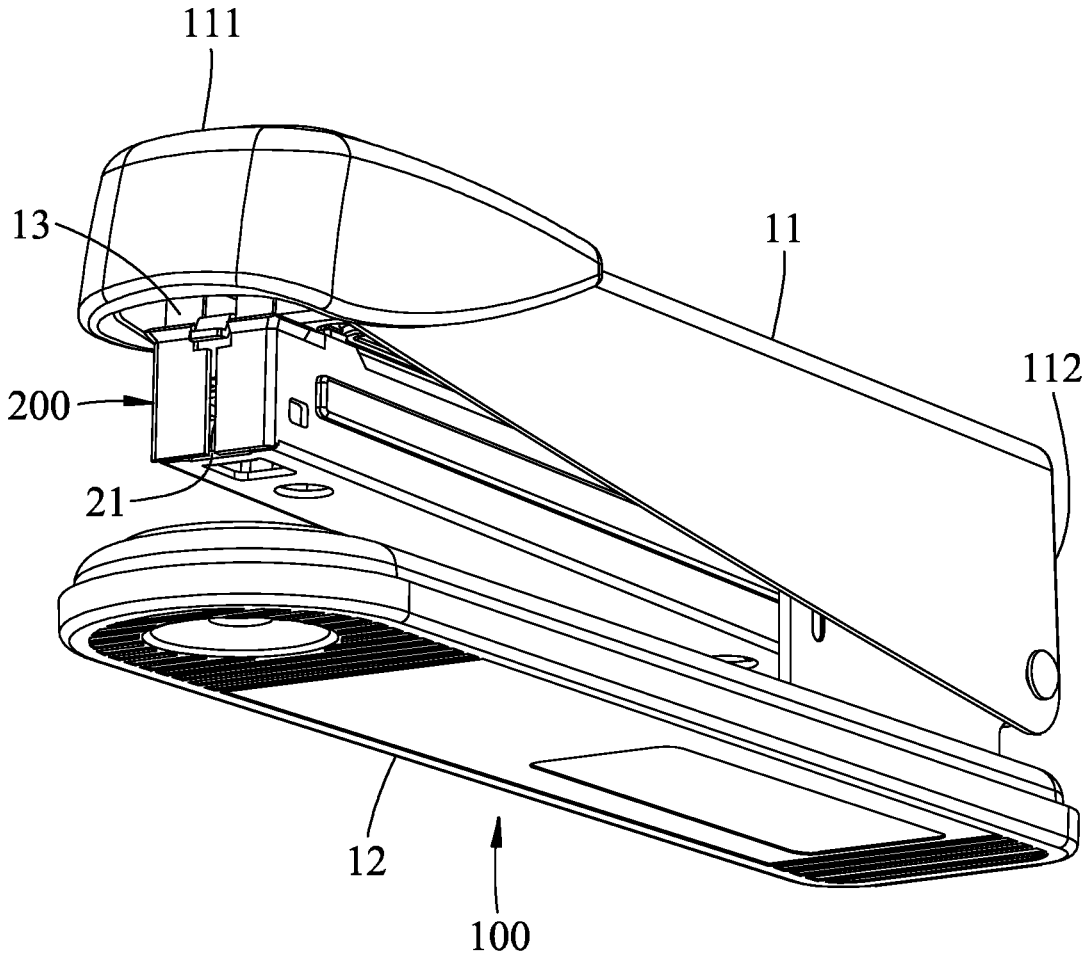
FIG. 2 is another perspective view of the first embodiment.
Figure 3:
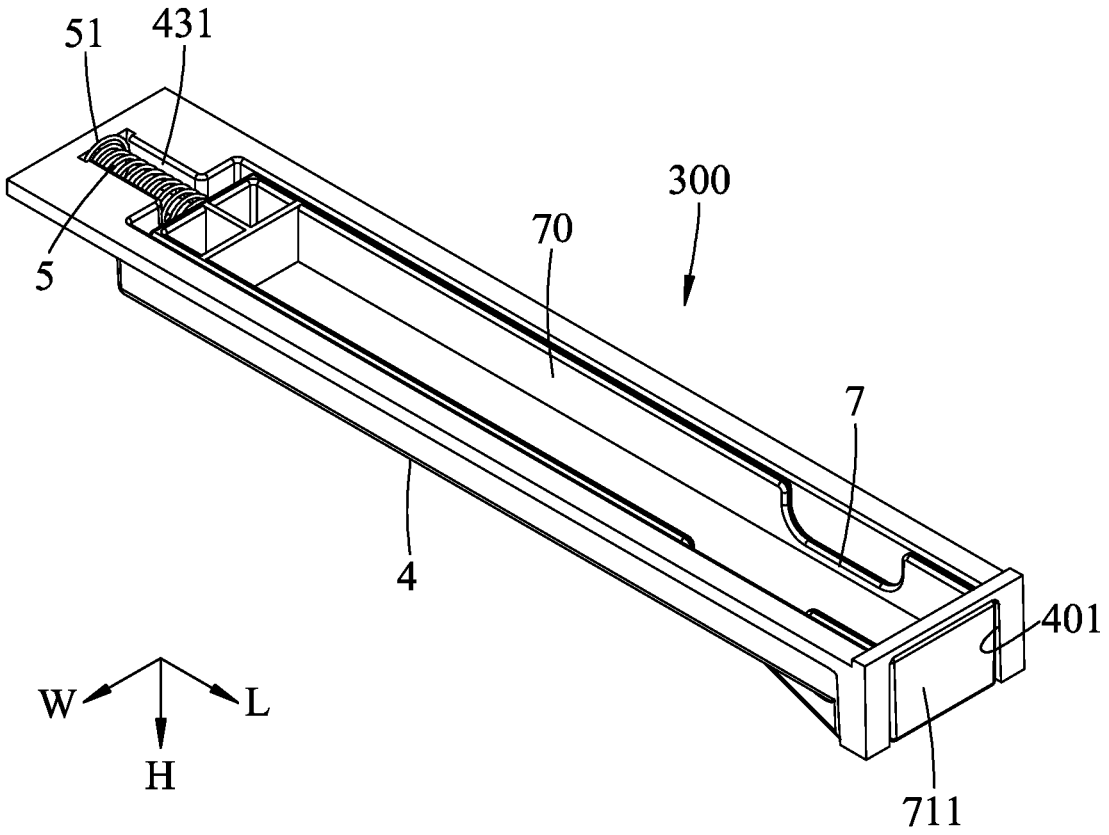
FIG. 3 is a perspective view of a spare magazine of the first embodiment.

Referring to FIGS. 1, 2 and 3, a first embodiment of a stapler of the disclosure is adapted for hammering a plurality of staples (not shown), and for storing a plurality of spare staples (not shown). The stapler includes a main unit 100, a primary magazine 200 and a spare magazine 300.

The main unit 100 includes a first main body 11, a second main body 12 and a hammer 13. The first main body 11 has a press end 111 and a fulcrum end 112 that is opposite to the press end 111. The second main body 12 is connected pivotally to the fulcrum end 112 of the first main body 11. The first main body 11 is formed with a fulcrum end opening 113 at the fulcrum end 112, and defines a housing space 10 that is spatially communicated with the fulcrum end opening 113. The hammer 13 is mounted proximately to the press end 111 and is adapted for hammering the staples during pivotal movements of the first and second main bodies 11, 12 relative to each other.

It should be noted that the stapler in the present embodiment is a heavy duty desktop stapler. Under normal circumstances, the second main body 12 is placed on a desktop, and a user may press on the press end 111 of the first main body 11 such that the first main body 11 pivots relative to the second main body 12, driving the hammer 13 to hammer the staples.

The primary magazine 200 is pivotally mounted to the first main body 11 of the main unit 100, is adapted for storing the staples, and has a hammering opening 21 that is proximate to the press end 111 of the first main body 11 and that faces the second main body 12 of the main unit 100. During the pivot action of the first main body 11 relative to the second main body 12, the hammer 13 of the main unit 100 is moved to extend through the hammering opening 21 and hammers the staples out of the primary magazine 200.

Figure 4:
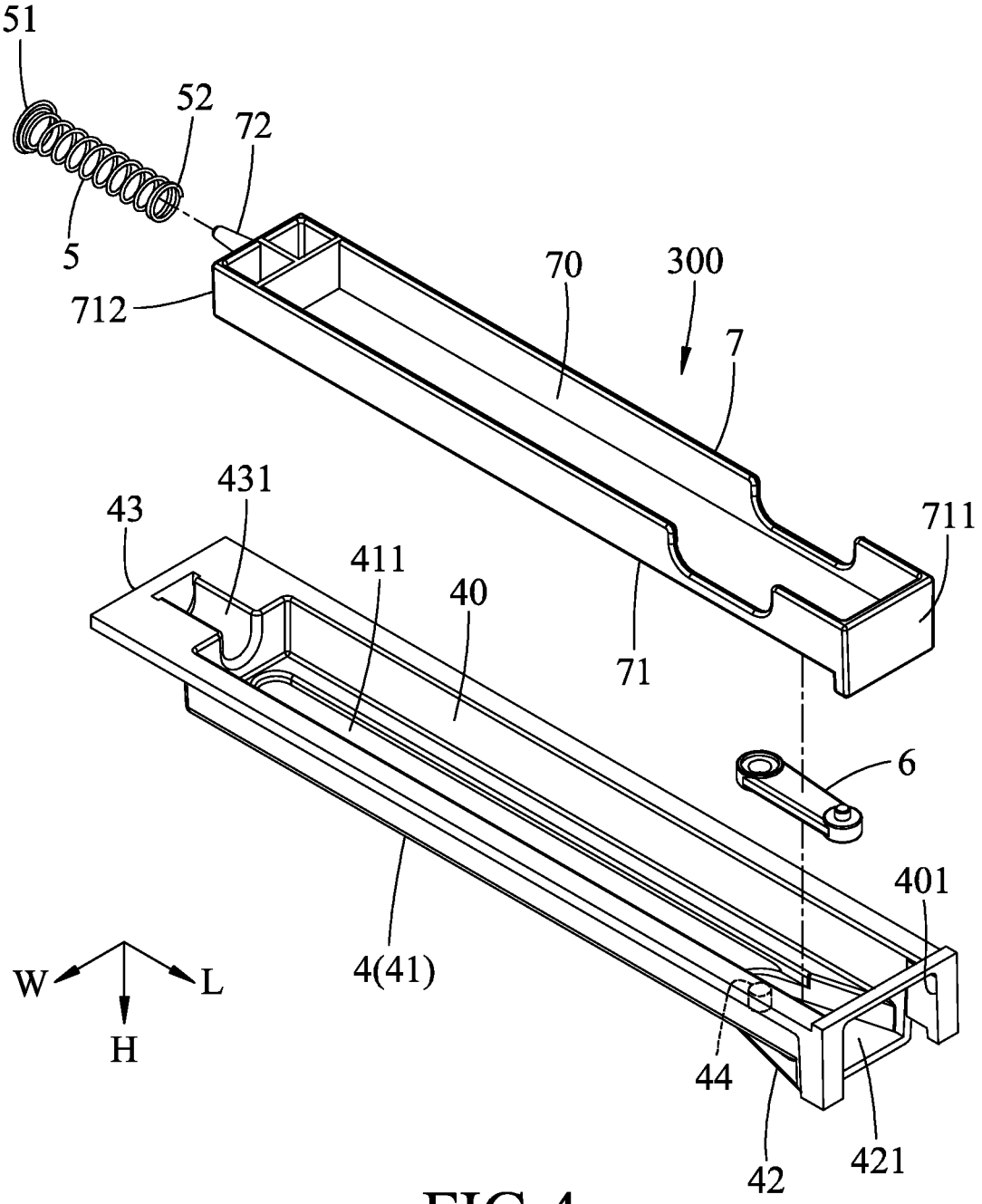
FIG. 4 is an exploded perspective view of the spare magazine of the first embodiment.
Figure 5:
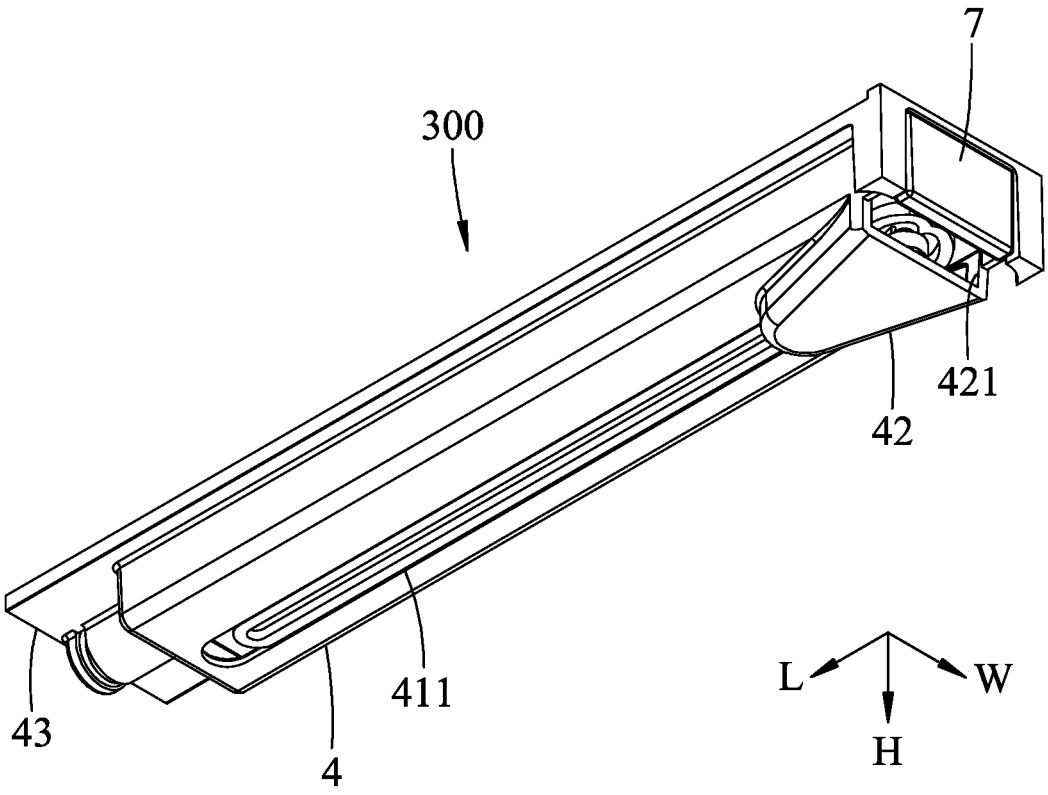
FIG. 5 is another perspective view of the spare magazine of the first embodiment.

Referring to FIGS. 3, 4 and 5, the spare magazine 300 is movably installed in the first main body 11 of the main unit 100, is adapted for storing the spare staples, and includes a casing unit 4, a resilient member 5, a pivot member 6 and a sliding carrier 7.

The casing unit 4 includes a casing body 41, a protruding body 42, an extending body 43 and a pivot pin 44.

The casing body 41 extends in a length direction (L) and defines a receiving space 40. The protruding body 42 extends from the casing body 41 in a height direction (H) perpendicular to the length direction (L), and defines a pivot space 421 that extends in the height direction (H) from an end of the receiving space 40. The casing unit 4 is formed with a casing opening 401 that is proximate to the fulcrum end opening 113 of the first main body 11 of the main unit 100 (see FIG. 1), and that is directly and spatially communicated with the receiving space 40 and the pivot space 421. The casing unit 4 is further formed with a guiding slot 411 that is elongated in the length direction (L), that extends through the casing body 41 and the protruding body 42, and that is directly and spatially communicated with the receiving space 40 and the pivot space 421.

The extending body 43 of the casing unit 4 extends parallel to the length direction (L) from an end of the casing body 41 that is opposite to the casing opening 401, and is formed with an installation groove 431 that is directly and spatially communicated with the receiving space 40 (i.e., the installation groove 431 is opposite to the casing opening 401).

The pivot pin 44 of the casing unit 4 protrudes inwardly from the protruding body 42 into the pivot space 421, and extends parallel to the height direction (H). In the present embodiment, the casing body 41, the protruding body 42, the extending body 43 and the pivot pin 44 are molded as one piece.

Figure 6:
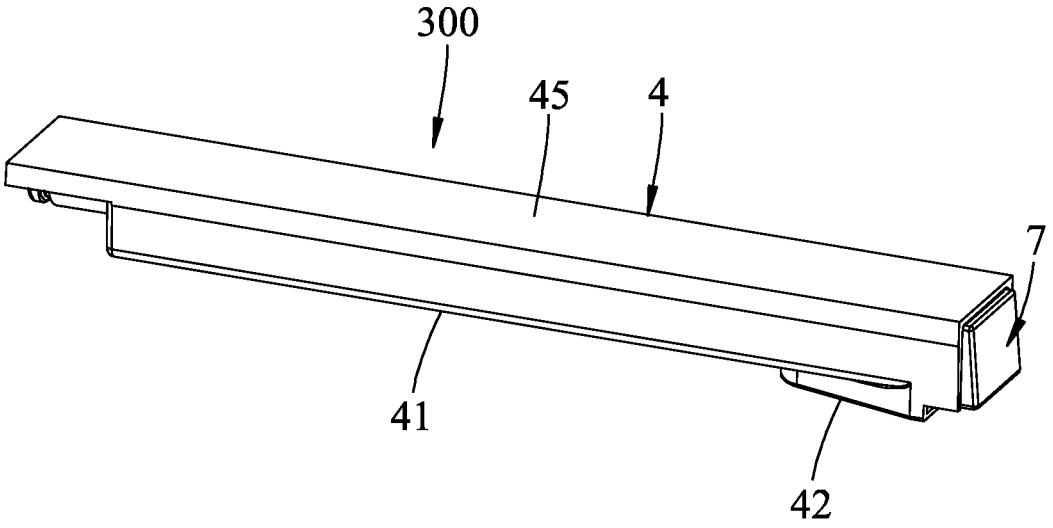
FIG. 6 is a perspective view of the spare magazine of a variation of the first embodiment, illustrating the spare magazine further including a cover body.

Referring further to FIG. 6, in other variations of the present embodiment, the casing unit 4 may further include a cover body 45 that is removably connected to the casing body 41, with the protruding body 42 and the cover body 45 being opposite to each other in the height direction (H), for covering the receiving space 40 of the casing body 41. In such variations, when the spare magazine 300 is detached from the first main body 11 of the main unit 100, it can be used alone as a staple storage box.

Referring to FIGS. 3, 4, 7 and 8, the pivot member 6 of the spare magazine 300 is pivotally disposed in the pivot space 421 of the protruding body 42 of the casing unit 4, and has a pivot end 61, a free end 62 and a positioning pin 63.

Figure 8:
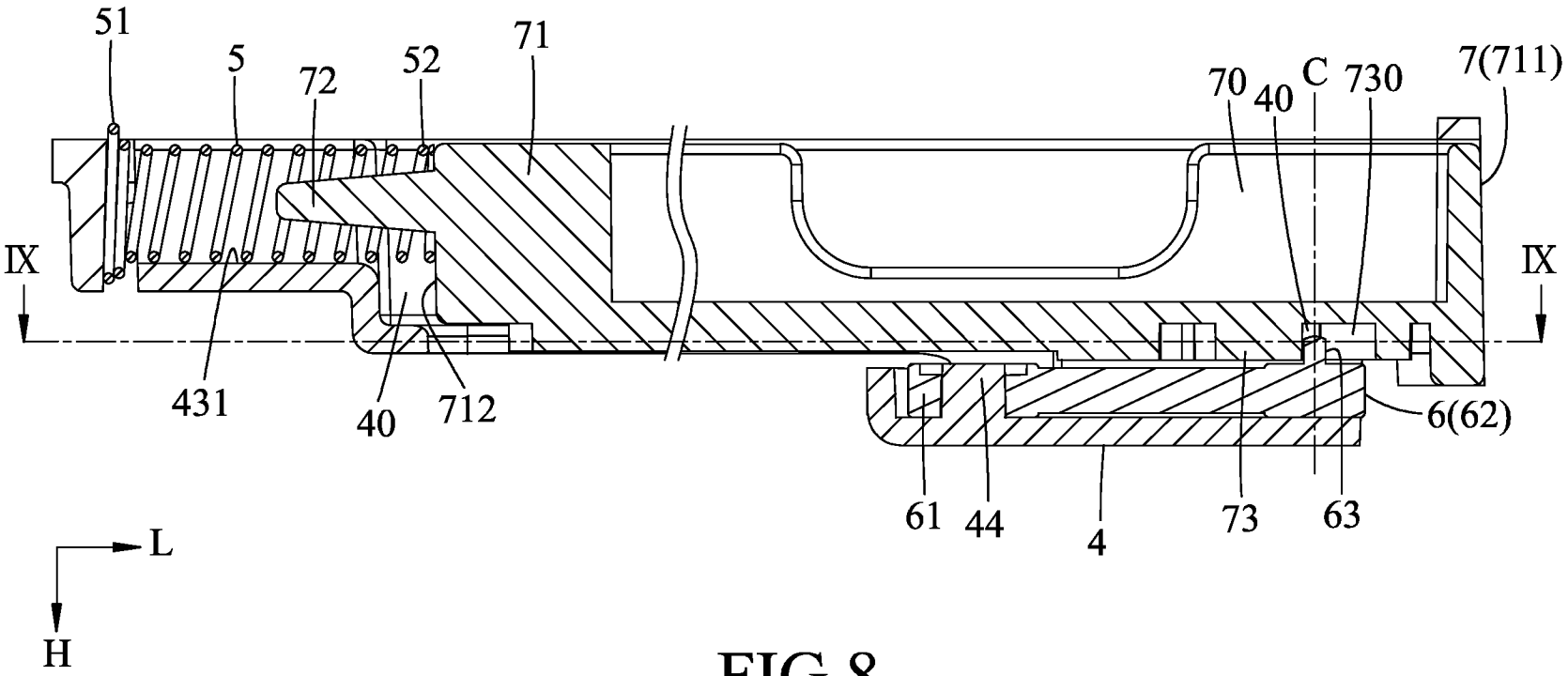
FIG. 8 is a fragmentary sectional side view of the spare magazine of the first embodiment.
Figure 10:
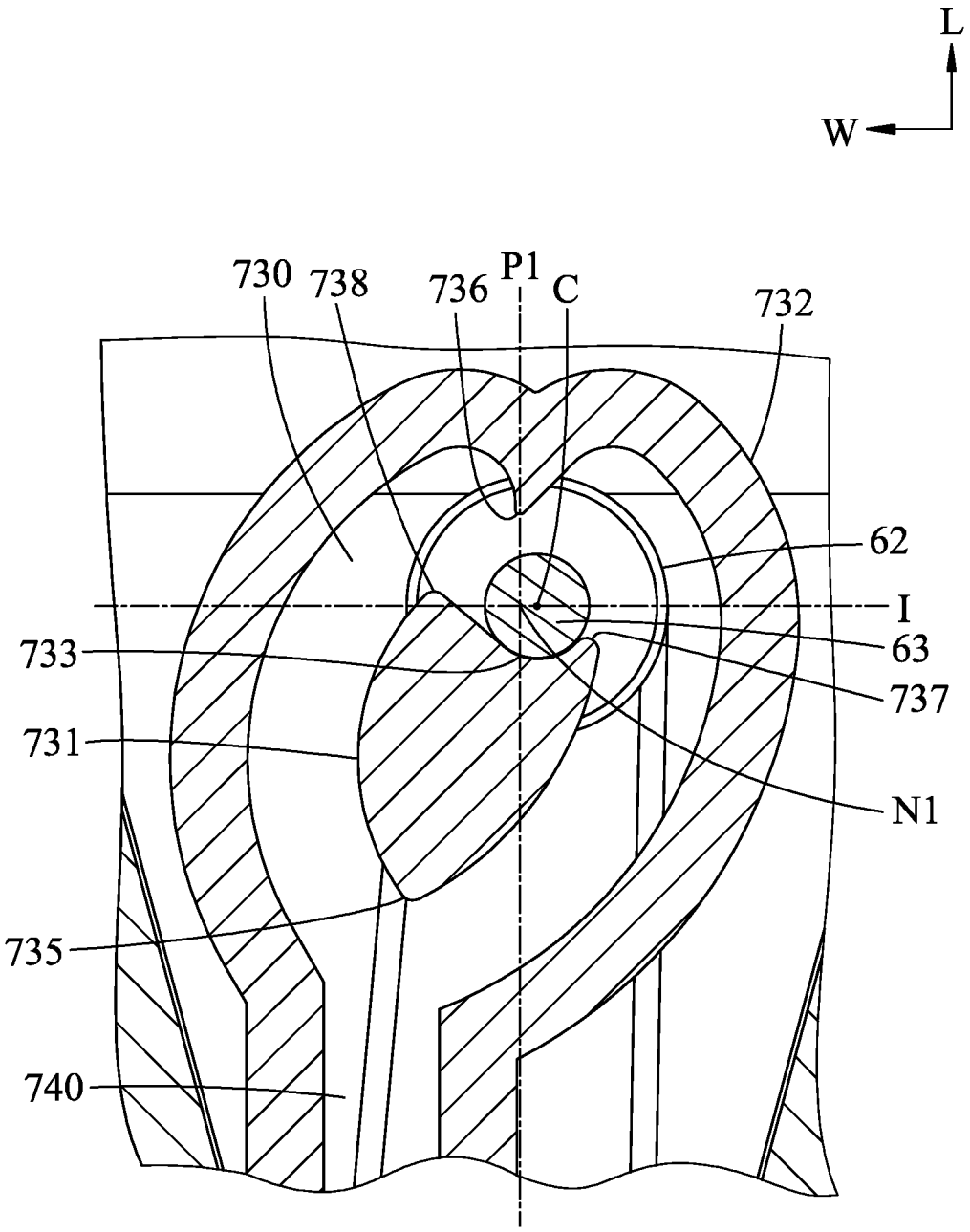
FIG. 10 is an enlarged fragmentary view of FIG. 9, illustrating a positioning pin being slidably inserted in a main track portion of the sliding carrier.

The pivot end 61 is connected to the pivot pin 44 of the casing unit 4 and serves as a pivot of the pivot member 6. The free end 62 is opposite to the pivot end 61 and is proximate to the casing opening 401 of the casing unit 4. The positioning pin 63 is distal from the pivot end 61, is formed at the free end 62, and extends into the receiving space 40 of the casing unit 4. As shown in FIGS. 8 and 10, the positioning pin 63 has a geometric centerline (C) extending in the height direction (H).

The sliding carrier 7 of the spare magazine 300 includes a carrier body 71, a securing portion 72, a main track portion 73 and an extending track portion 74. In the present embodiment, the carrier body 71, the securing portion 72, the main track portion 73 and the extending track portion 74 are molded as one piece.

The carrier body 71 of the sliding carrier 7 extends in the length direction (L), is slidably received in the receiving space 40 of the casing unit 4, and defines a storage space 70 adapted for storing the spare staples. The carrier body 71 has a push end 711 and an abutment end 712 being opposite to each other in the length direction (L). The push end 711 is exposed at the casing opening 401 of the casing unit 4 for access to the user.

The securing portion 72 of the sliding carrier 7 extends from the abutment end 712 of the carrier body 71 into the installation slot 431 of the extending body 43. In this embodiment, the resilient member 5 is configured as a compression spring, is received in the installation groove 431 of the casing unit 4, and is connected between the casing unit 4 and the sliding carrier 7. The resilient member 5 has a first end 51 secured in the installation groove 431, and a second end 52 sleeved on the securing portion 72 and abutting against the abutment end 712 of the carrier body 71.

Since the resilient member 5 is retained in the installation groove 431 of casing unit 4 and is sleeved on the securing portion 72, deflection or buckling of the resilient member 5 during its compression is prevented.

In other embodiments of the disclosure, the sliding carrier 7 may not include the securing portion 72.

Referring to FIGS. 7 to 10, the main track portion 73 of the sliding carrier 7 protrudes from the carrier body 71 in the height direction (H), and has an island block 731 and a surrounding wall 732.

The island block 731 has a concave end 733 and a tapered end 735 that are respectively proximate to and distal from the push end 711 of the carrier body 71.

The surrounding wall 732 surrounds and is spaced apart from the island block 731, and has a protruding guide end 736 that is proximate to and protrudes toward the concave end 733 of the island block 731. The surrounding wall 732 cooperates with the island block 731 to define a main track 730 therebetween, and the positioning pin 63 of the pivot member 6 is inserted into the main track 730 and is slidable therein relative to the casing unit 4 during sliding movement of the sliding carrier 7 parallel to the length direction (L).

Figure 7:
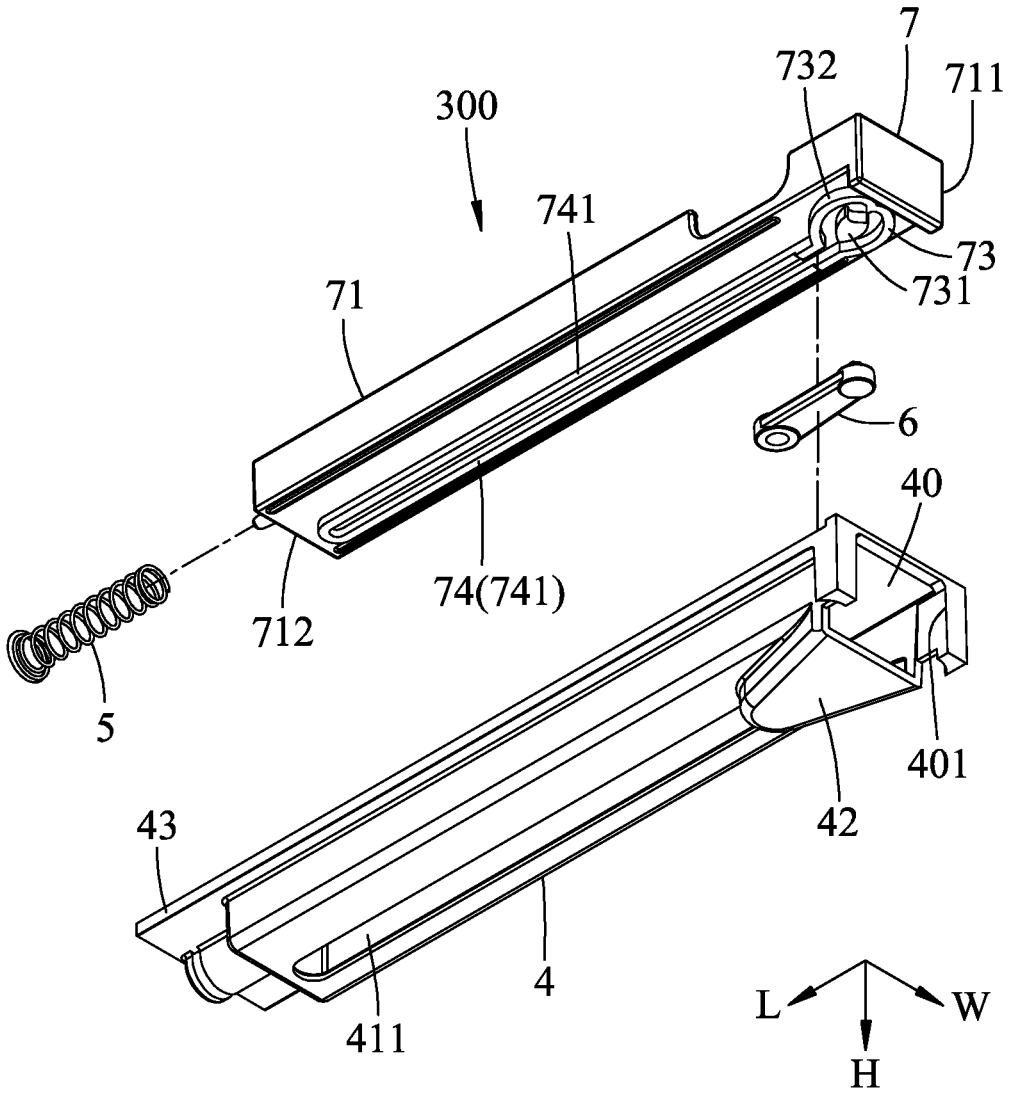
FIG. 7 is another exploded perspective view of the spare magazine of the first embodiment.

Referring to FIG. 7, the extending track portion 74 of the sliding carrier 7 protrudes from the carrier body 71 in the height direction (H), is connected to the main track portion 73, is movably retained in the guiding slot 411 of the casing body 41 of the casing unit 4, defines a straight track 740 that is connected to the main track 730, and has two extending walls 741. The extending walls 741 are connected to each other, are connected to the surrounding wall 732 of the main track portion 73, and cooperate with the surrounding wall 732 to form a closed loop, such that the positioning pin 63 inserted in the main track 730 is further slidable in the straight track 740 between the extending walls 741 of the extending track portion 74 during the sliding movement of the sliding carrier 7.

Figure 9:
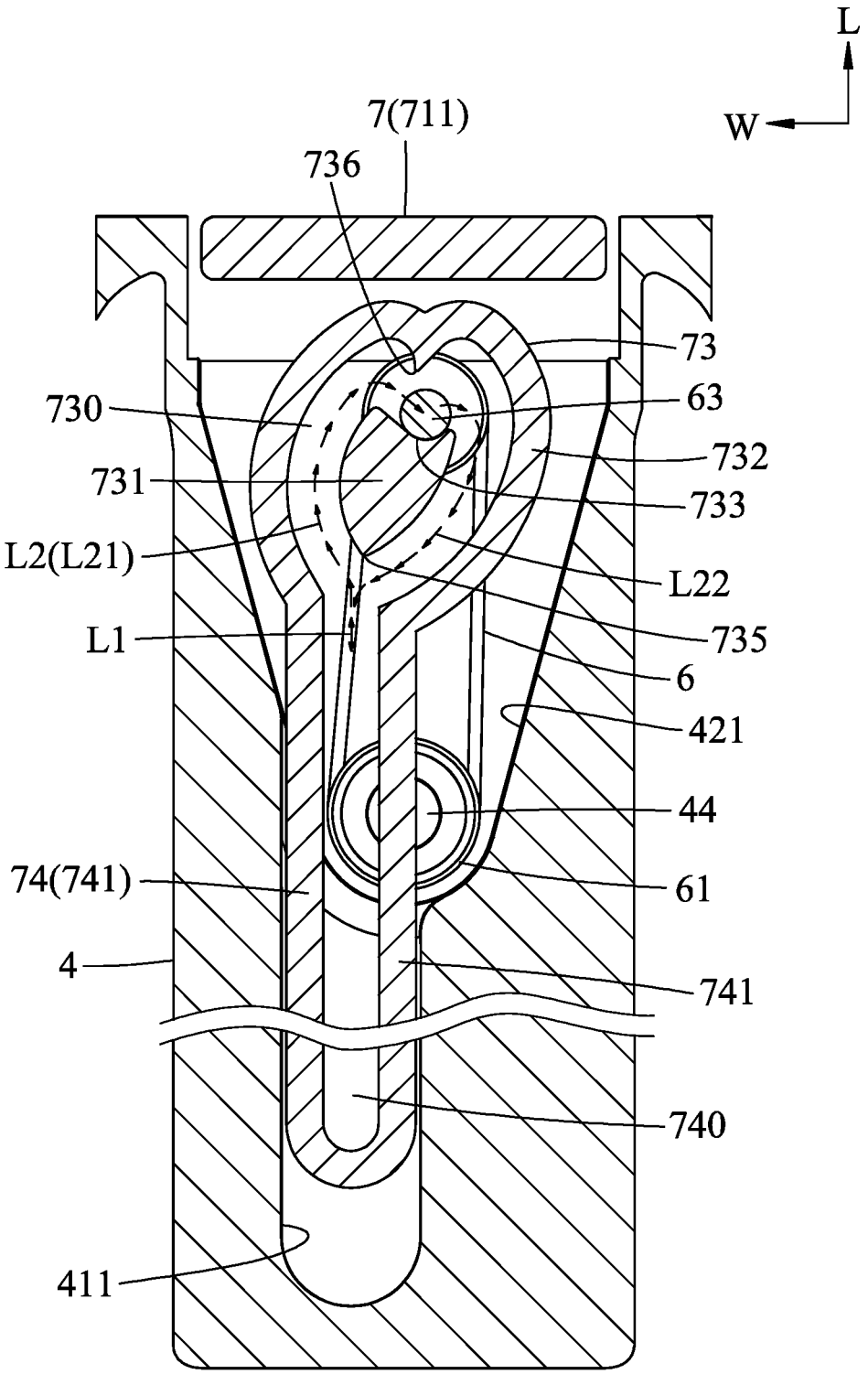
FIG. 9 is a fragmentary sectional top view of the spare magazine, taken along line IX-IX in FIG. 8, illustrating a sliding carrier at a closed position relative to a casing unit.
Figure 11:
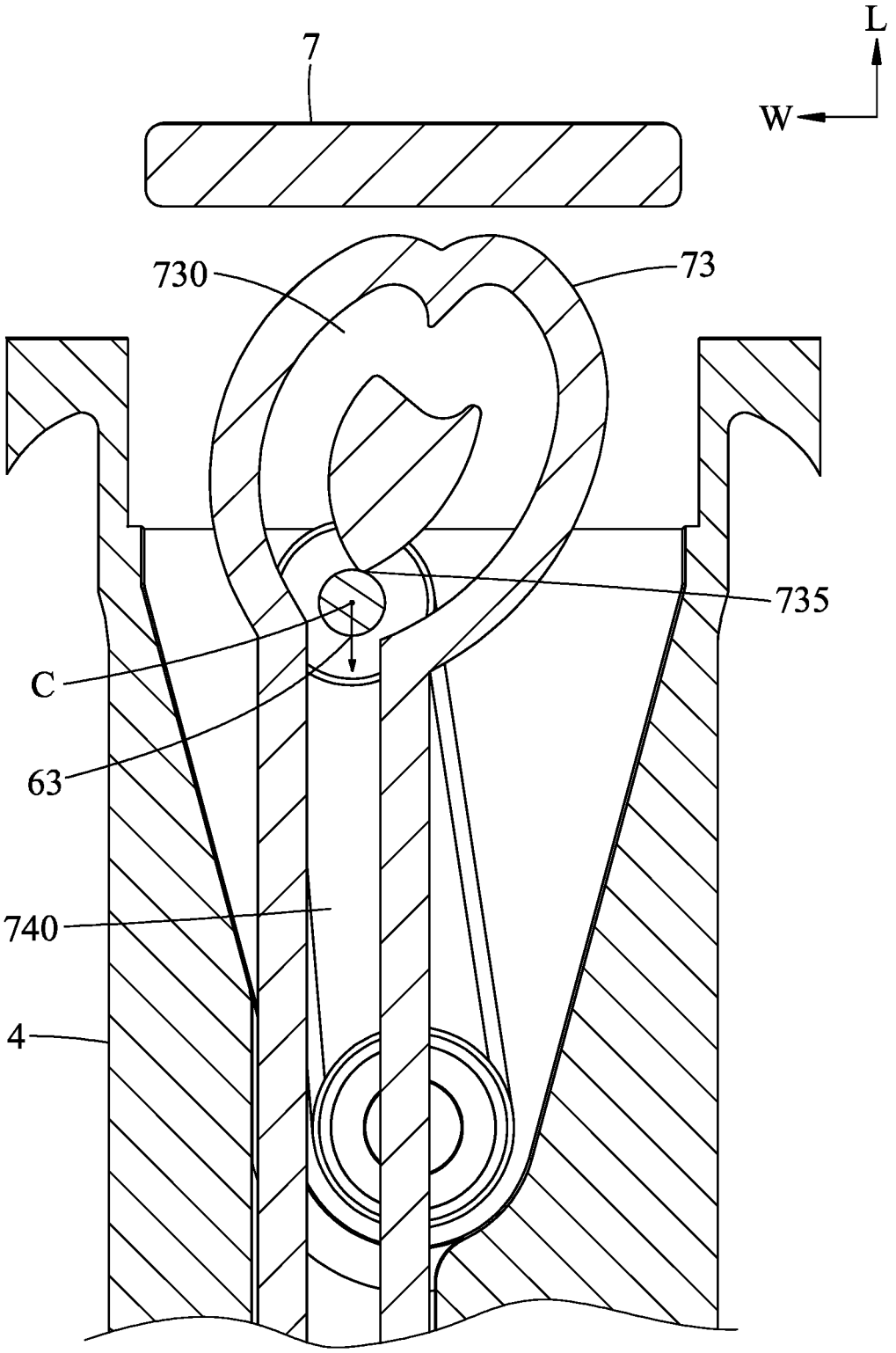
FIG. 11 is a fragmentary sectional top view of the spare magazine of the first embodiment, illustrating the sliding carrier at a first open position relative to the casing unit.
Figure 12:
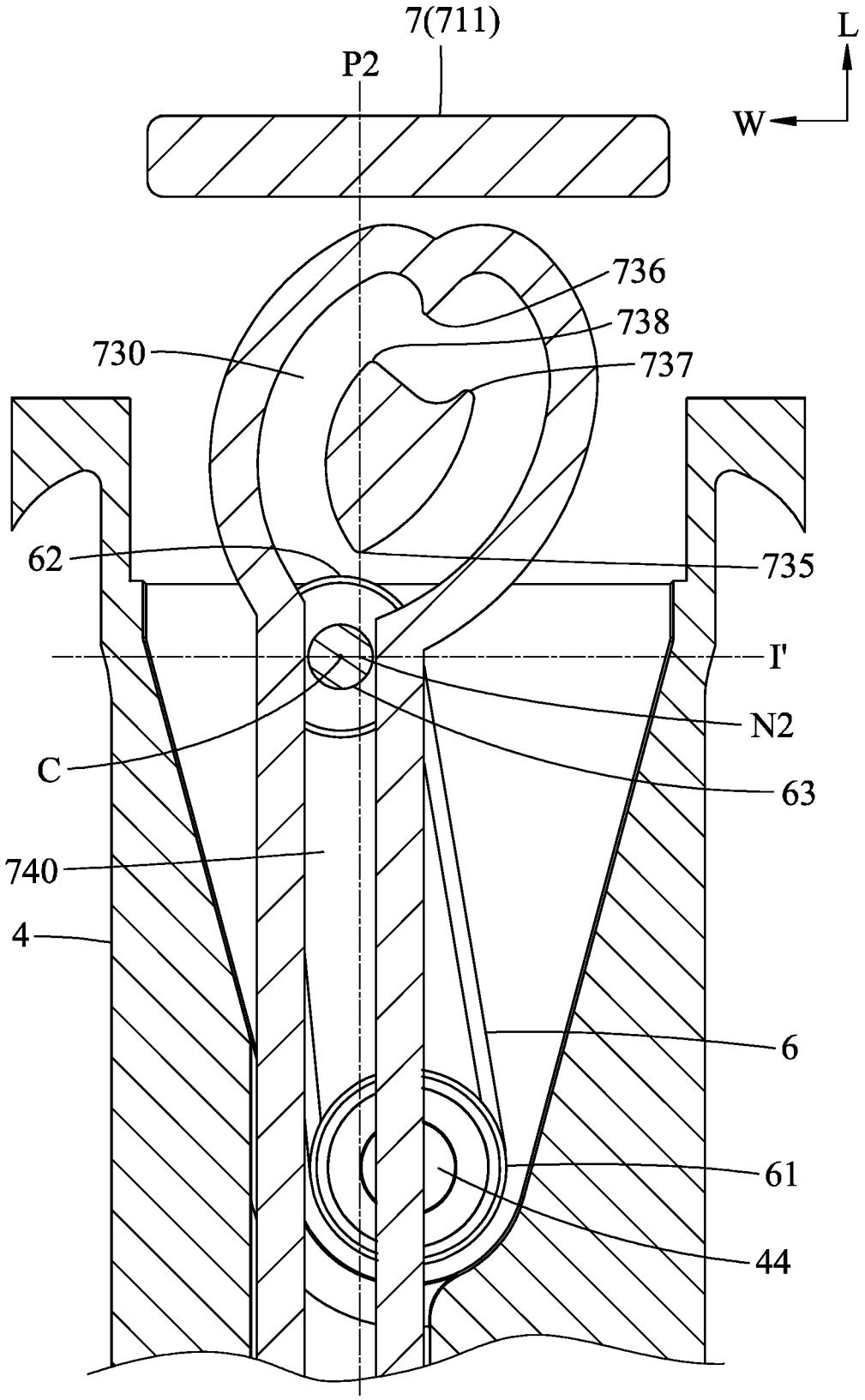
FIG. 12 is a fragmentary sectional top view of the spare magazine of the first embodiment, illustrating the sliding carrier at a second open position relative to the casing unit.

Referring to FIGS. 9, 11 and 12, in the present embodiment, the positioning pin 63 of the pivot member 6 is slidable in the main track 730 along a heart-shaped route (L2) that is defined between the island block 731 and the surrounding wall 732, and in the straight track 740 along a straight-lined route (L1) that is connected to the heart-shaped route (L2) and that is defined between the extending track portion 74.

For sake of brevity, in the description below, "left and right sides" of the elements of the embodiment refer to the left and right sides of FIGS. 9 to 12.

Specifically, the heart-shaped route (L2) has a left sub-route (L21) and a right sub-route (L22) that is shorter than the left sub-route (L21). The left sub-route (L21) is disposed on the left of the island block 731, and the right sub-route (L22) is disposed on the right of the island block 731.

It should be noted that, by virtue of configurations of the tapered end 735 and protruding guide end 736 of the sliding carrier 7, which will be described later in further details, the positioning pin 63 is forced to enter the heart-shaped route (L2) from the straight-lined route (L1) via the left sub-route (L21), and to exit the heart-shaped route (L2) to the straight-lined route (L1) via the right sub-route (L22) during the sliding movement of the sliding carrier 7.

However, in other embodiments of the disclosure, the left and right sub-routes (L21, L22) are not limited to the above configurations. For example, the right sub-route (L22) may be longer than the left sub-route (L21), and the positioning pin 63 may enter the heart-shaped route (L2) via the right sub-route (L22), and exit the heart-shaped route (L2) via the left sub-route (L21), as long as the positioning pin 63 is able to enter or exit the heart-shaped route (L2) smoothly without being stopped or slowed down at the tapered end (735) of the island block (731) or the protruding guide end (736) of the surrounding wall (732).

Figure 13:
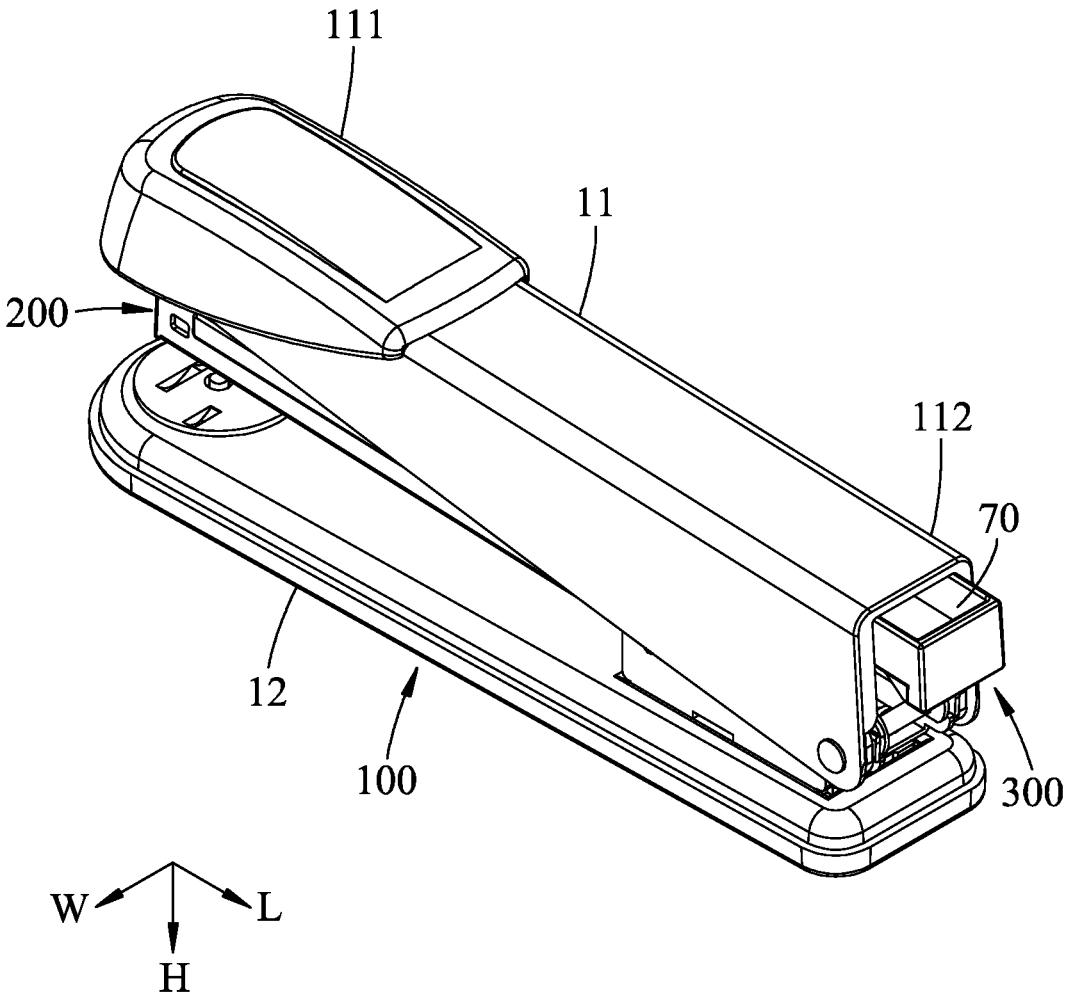
FIG. 13 is a perspective view of the first embodiment, illustrating the sliding carrier at the second open position, and a storage space of the sliding carrier being exposed to the external environment.

The sliding carrier 7 is slidable relative to the casing unit 4 among a closed position (see FIGS. 3, 5, 9 and 10), a first open position (see FIG. 11) and a second open position (see FIGS. 12 and 13).

When the sliding carrier 7 is at the closed position, the push end 711 of the sliding carrier 7 is disposed at the casing opening 401 of the casing unit 4 such that the storage space 70 of the sliding carrier 7 is enclosed in the casing unit 4. At this time, the resilient member 5 is compressed and exerts a biasing force on the sliding carrier 7 to push it toward the first open position, and the positioning pin 63 of the pivot member 6 is proximate to the protruding guide end 736 of the surrounding wall 732 and abuts against the concave end 733 of the island block 731.

It should be noted that, as shown in FIG. 10, an imaginary plane (I) that extends through the geometric center line (C) of the positioning pin 63 and that is perpendicular to the length direction (L) intersects, at a first intersection (N1), a first plane (P1) that extends through the protruding guide end 736 and that is perpendicular to a width direction (W) which is perpendicular to the height direction (H) and the length direction (L). The first intersection (N1) does not overlap the geometric center line (C) of the positioning pin 63, and is disposed on the left of the geometric center line (C). During the sliding movement of the sliding carrier 7 from the closed position toward the first open position, such a configuration forces the positioning pin 63 to slide to the right of the protruding guide end 736 after hitting the protruding guide end 736. Therefore, as mentioned above, the positioning pin 63 is forced to go through the right sub-route (L22) to exit the heart-shaped route (L2).

When the sliding carrier 7 is at the first open position, the push end 711 of the sliding carrier 7 is disposed slightly out of the casing opening 401 of the casing unit 4, the positioning pin 63 is disposed at one end of the straight-lined route (L1) proximate to the tapered end 735 of the island block 731, and the resilient member 5 still exerts the biasing force on the sliding carrier 7 to push it toward the second open position.

When the sliding carrier 7 is at the second open position, the push end 711 of the sliding carrier 7 is disposed further outside of the casing opening 401 of the casing unit 4 such that the storage space 70 is exposed to the external environment (see FIG. 13), and the positioning pin 63 is disposed at the other end of the straight-lined route (L1) distal from the tapered end 735 of the island block 731. At this time, the resilient member 5 is not compressed and does not exert the biasing force on the sliding carrier 7.

It should also be noted that, as shown in FIG. 12, another imaginary plane (I') that extends through the geometric centerline (C) of the positioning pin 63 and that is perpendicular to the length direction (L) intersects, at a second intersection (N2), a second plane (P2) that extends through the tapered end 735 and that is perpendicular to the width direction (W). The second intersection (N2) does not overlap the geometric center line (C) of the positioning pin 63, and is disposed on the right of the geometric center line (C). Similarly, during the sliding movement of the sliding carrier 7 from the first open position toward the closed position, such a configuration forces the positioning pin 63 to slide to the left of the tapered end 735 after hitting the tapered end 735, thereby forcing the positioning pin 63 to enter the heart-shaped route (L2) via the left sub-route (L21).

Combining the abovementioned configurations with the movements of the resilient member 5, the pivot member 6 and the sliding carrier 7 relative to the casing unit 4, the spare magazine 300 is operable with a push-to-open mechanism. A detailed description of the push-to-open mechanism and operation of spare magazine 300 is described below.

Referring again to FIGS. 9 and 10, to open the sliding carrier 7 from the closed position, the user presses the press end 711 of the sliding carrier 7, moving the sliding carrier 7 slightly into the casing unit 4 against the biasing force of the resilient member 5 and causing the positioning pin 63 of the pivot member 6 to hit the protruding guide end 736 of the surrounding wall 732. The positioning pin 63 is in turn forced to slide toward the right of the protruding guide end 736 and enters the right sub-route (L22) of the heart-shaped route (L2). At this moment, the user releases his hand, and the sliding carrier 7, biased by the resilient member 5 (see FIG. 8), starts sliding out of the casing unit 4, causing the positioning pin 63 to keep sliding along the right sub-route (L22). When the sliding carrier 7 reaches the first open position, the biasing force of the resilient member 5 continues to push the sliding carrier 7 toward the second open position with the positioning pin 63 sliding into the straight-lined route (L1) to further exposing the storage space 70 to the external environment. Finally, when the sliding carrier 7 arrives at the second open position, the resilient member 5 returns to its relaxed (i.e. uncompressed) state, the sliding carrier 7 stops sliding, and the positioning pin 63 stops at the end of the straight-lined route (L1) distal from the tapered end 735 of the island block 731.

Referring again to FIGS. 9, 11 and 12, to convert the sliding carrier 7 back to the closed position, the user presses the press end 711 of the sliding carrier 7, pushing the sliding carrier 7 into the casing unit 4 and causing the positioning pin 63 to slide from the straight-lined route (L1) toward the heart-shaped route (L2), that is, from the second open position toward the first open position, and hit the tapered end 735 of the island block 731. The positioning pin 63 is in turn forced to slide toward the left of the tapered end 735 and enters the left sub-route (L21) of the heart-shaped route (L2). As the user keeps pushing the sliding carrier 7, the positioning pin 63 continues to slide along the left sub-route (L21) and reaches the left of the protruding guide end 736. At this moment, the user releases his hand, and the sliding carrier 7, biased by the resilient member 5, slides slightly in a direction away from the casing unit 4 until the concave end 733 of the island block 731 abuts against the positioning pin 63. The sliding carrier 7 is now at the closed position, and the spare staples are securely stored in the storage space 70 thereof.

Figure 14:
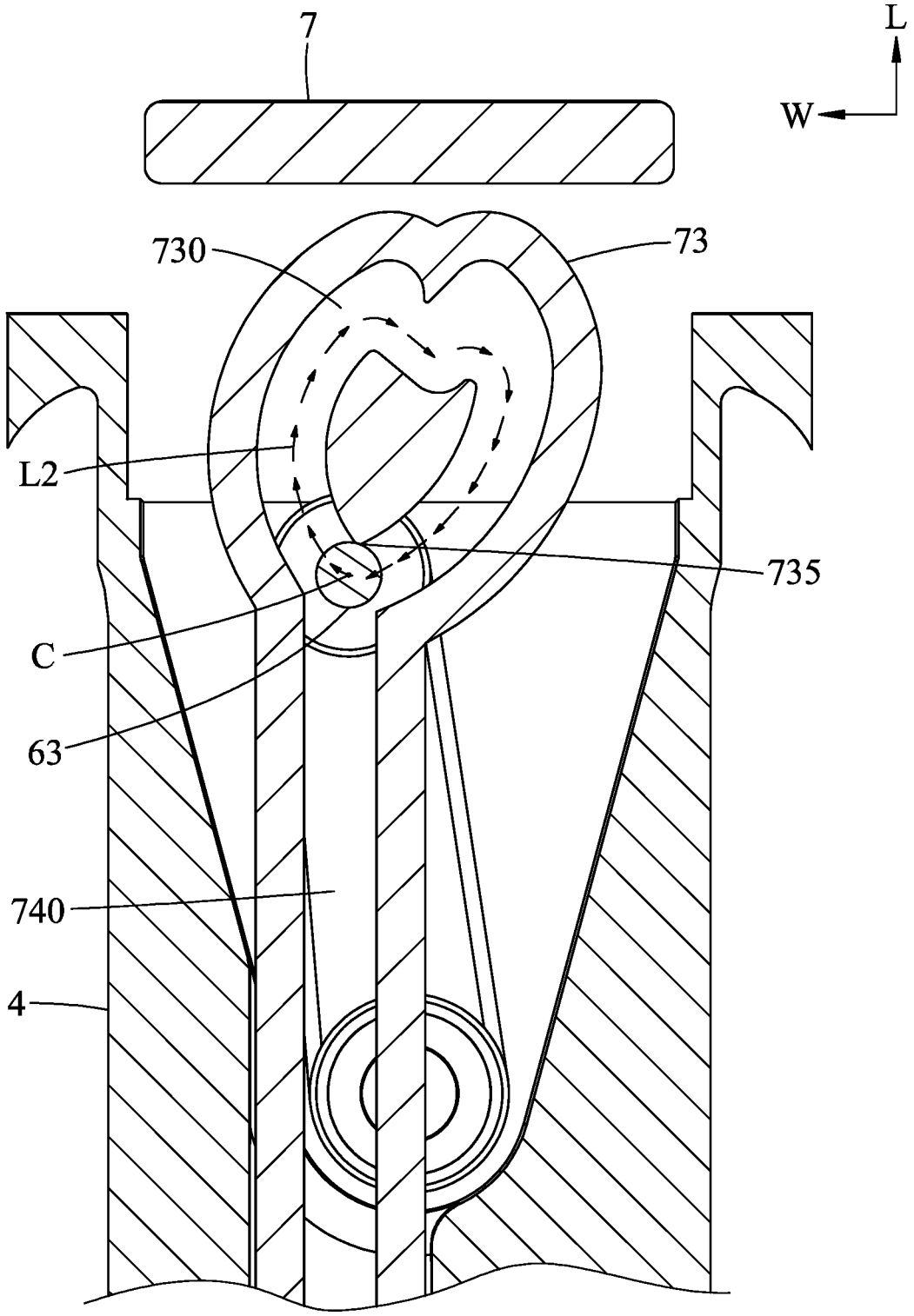
FIG. 14 is a fragmentary sectional top view of the spare magazine of another variation of the first embodiment, illustrating the sliding carrier at the first open position.

Referring to FIG. 14, in a variation of the first embodiment, the configurations of the spare magazine 300 is slightly altered such that when the sliding carrier 7 is biased by the resilient member 5 to slide out from the closed position, the positioning pin 63 only slides along the heart-shaped route (L2). In other words, when the sliding carrier 7 arrives at the first open position, the resilient member 5 is relaxed and does not push the sliding carrier 7 to slide along the straight-lined route (L1). The present variation demonstrates that, as long as the first or second intersection (N1, N2) does not overlap the geometric center line (C) of the positioning pin 63, the sliding carrier 7 is able to transition smoothly between the open and closed positions without being stopped or slowed down at either the tapered end 735 or the protruding guide end 736.

Figure 15:
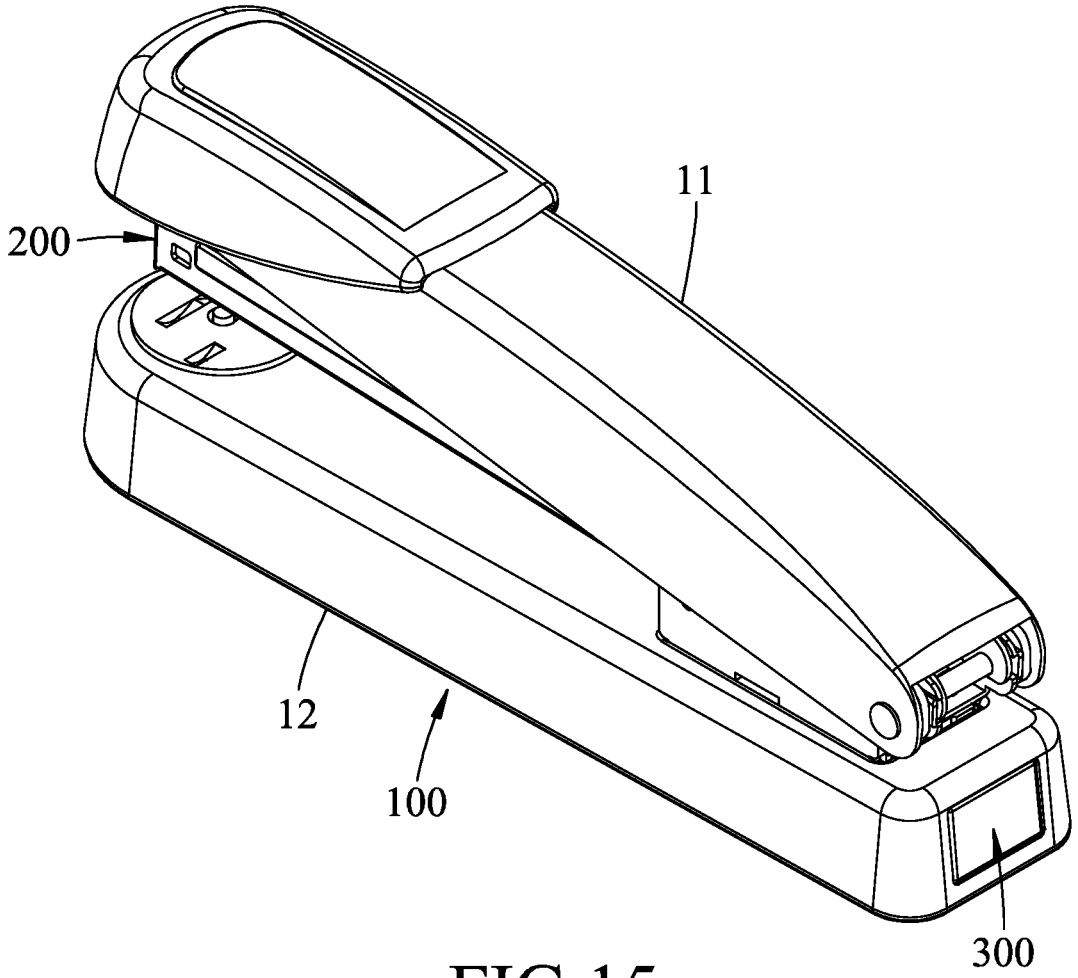
FIG. 15 is a perspective view of a second embodiment of the stapler according to the disclosure.

Referring to FIG. 15, a second embodiment of the stapler according to the disclosure is similar to the first embodiment. The difference between the two embodiment resides in that, in the second embodiment, the spare magazine 300 is installed in the second main body 12 of the main unit 100 instead of the first main body 11. In a similar manner, the second embodiment provides the same functionality as mentioned in the first embodiment.

Figure 16:
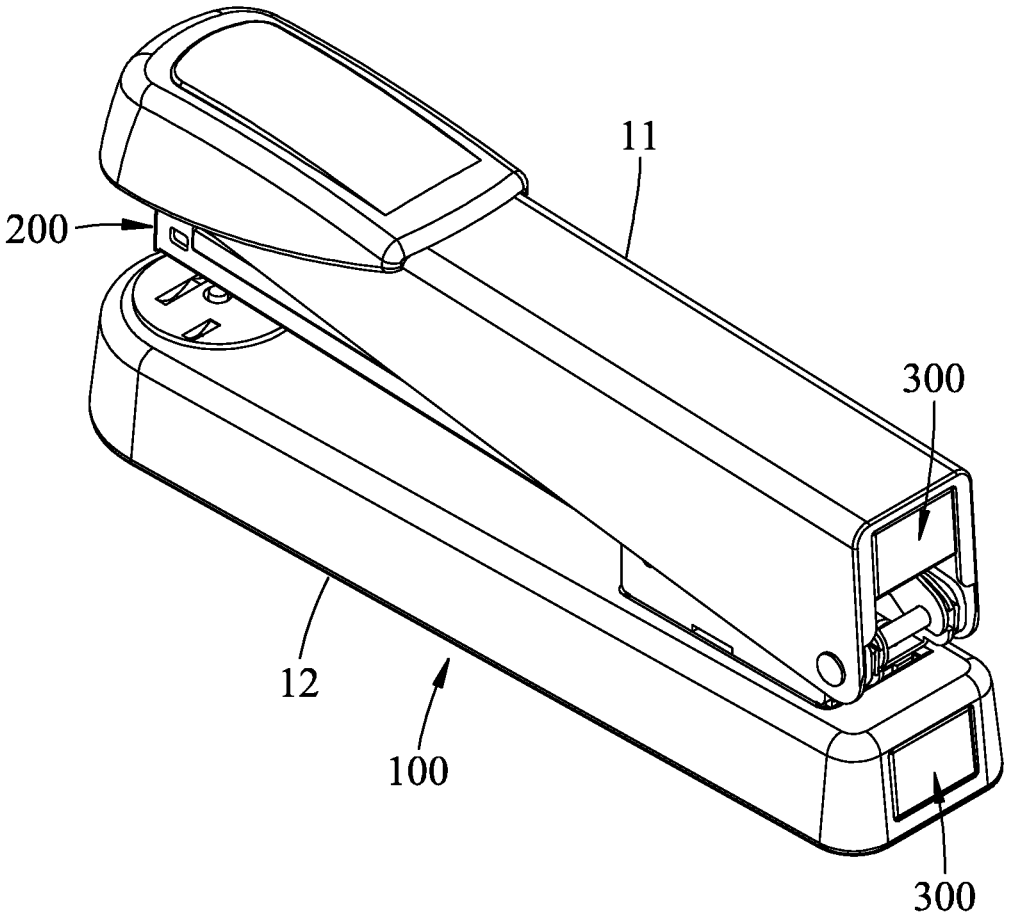
FIG. 16 is a perspective view of a variation of the second embodiment.

Referring to FIG. 16, a variation of the second embodiment of the stapler includes two of the spare magazines 300 that are installed respectively in the first and second main bodies 11, 12 of the main unit 100, so that more spare staples can be stored in the stapler.

In sum, compared with the prior art, the stapler of the present disclosure is able to hold more staples which is both convenient and time-saving. Plus, by virtue of the push-to-open mechanism of the spare magazine 300, the stapler of the present disclosure is fairly intuitive and easy for the user to operate.

In the description above, for the purposes of explanation, numerous specific details have been set forth in order to provide a thorough understanding of the embodiments. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what are considered the exemplary embodiments, it is understood that this disclosure is not limited to the disclosed embodiments but is intended to cover various arrangements included within the spirit and scope of the broadest interpretation so as to encompass all such modifications and equivalent arrangements.

What is claimed is:

1. A spare magazine adapted to be installed in a stapler and adapted for storing a plurality of spare staples, said spare magazine comprising:

a casing unit defining a receiving space and a pivot space that extends in a height direction from an end of said receiving space, said casing unit having a casing opening that is directly and spatially communicated with said receiving space and said pivot space;

a pivot member pivotally disposed in said pivot space of said casing unit, and having a pivot end that is connected to said casing unit and that serves as a pivot of said pivot member, and a positioning pin that is distal from said pivot end, and that extends into said receiving space of said casing unit; and a sliding carrier having a carrier body that is slidably received in said receiving space of said casing unit, that defines a storage space adapted for storing the spare staples, and that has a push end being exposed at said casing opening of said casing unit for access to a user, and a main track portion that protrudes from said carrier body in the height direction, and that has an island block having a concave end and a tapered end that are respectively proximate to and distal from said push end of said carrier body, and a surrounding wall surrounding and being spaced apart from said island block, having a protruding guide end that is proximate to and protrudes toward said concave end of said island block, and cooperating with said island block to define a main track therebetween, said positioning pin of said pivot member being inserted into said main track and being slidable in said main track along a heart-shaped route;

wherein said sliding carrier is slidable parallel to a length direction which is perpendicular to the height direction relative to said casing unit between a closed position and a first open position, said positioning pin being slidable in said main track along the heart-shaped route during the sliding movement of said sliding carrier parallel to the length direction;

wherein, when said sliding carrier is at the closed position, said push end of said sliding carrier is disposed at said casing opening of said casing unit such that said storage space of said sliding carrier is enclosed in said casing unit, said positioning pin is proximate to said protruding guide end of said surrounding wall and abuts against said concave end of said island block, and an imaginary plane extending through a geometric center line of said positioning pin which extends in the height direction and being perpendicular to the length direction intersects a first plane extending through said protruding guide end and being perpendicular to a width direction which is perpendicular to the height direction and the length direction at an intersection which does not overlap the geometric center line of said positioning pin; and wherein, when said sliding carrier is at the first open position, said push end of said sliding carrier is disposed outside of said casing opening of said casing unit such that said storage space is exposed to the external environment, said positioning pin is proximate to said tapered end of said island block, and another imaginary plane extending through the geometric center line of said positioning pin and being perpendicular to the length direction intersects a second plane extending through said tapered end and being perpendicular to the width direction at an intersection which does not overlap the geometric center line of said positioning pin.

2. The spare magazine as claimed in claim 1, wherein:

said casing unit further has an installation groove that is formed at an end thereof opposite to said casing opening, and that is directly and spatially communicated with said receiving space; and said spare magazine further comprises a resilient member that is received in said installation groove of said casing unit, and that is connected between said casing unit and said sliding carrier for biasing said sliding carrier toward the first open position.

3. The spare magazine as claimed in claim 2, wherein said sliding carrier further has a securing portion extending from said carrier body into said installation slot, said resilient member being sleeved on said securing portion.

4. The spare magazine as claimed in claim 1, wherein:

said heart-shaped route has a left sub-route and a right sub-route, said right sub-route being shorter than said left sub-route; and said positioning pin slides along said left sub-route during sliding movement of said sliding carrier from the first open position to the closed position, and slides along said right sub-route during sliding movement of said sliding carrier from the closed position to the first open position.

5. The spare magazine as claimed in claim 1, wherein, when said sliding carrier is at the first open position, said positioning pin is further slidable along a straight-lined route that is connected to the heart-shaped route for further exposing said storage space to the external environment.

6. The spare magazine as claimed in claim 5, wherein:

said casing unit includes a casing body that defines said receiving space, and that has a guiding slot extending therethrough and communicated directly and spatially with said receiving space and said pivot space;

said sliding carrier further has an extending track portion that protrudes from said carrier body in the height direction, that is movably retained in said guiding slot, that is connected to said main track portion, and that defines a straight track; and said positioning pin is slidable in said straight track along the straight-lined route.

7. The spare magazine as claimed in claim 6, wherein said extending track portion has two extending walls that are connected to each other, that are connected to said surrounding wall of said main track portion, that cooperatively define said straight track, and that cooperate with said surrounding wall to form a closed loop.

8. The spare magazine as claimed in claim 1, wherein said casing unit includes:

a casing body that defines said receiving space;

a cover body that is removably connected to said casing body for covering said receiving space; and a protruding body that extends from said casing body, that is opposite to said cover body in the height direction, and that defines said pivot space.

9. A stapler adapted for storing and hammering a plurality of staples and adapted for storing a plurality of spare staples, said stapler comprising:

a main unit including a first main body, a second main body that is connected pivotally to said first main body, and a hammer that is mounted to said first main body for hammering the staples;

a primary magazine mounted to said first main body of said main unit, adapted for storing the staples, and having a hammering opening that faces said second main body of said main unit, said hammer being operable to extend through said hammering opening; and at least one of said spare magazine as claimed in claim 1 being movably installed in said main unit.

10. The stapler as claimed in claim 9, wherein said at least one of said spare magazine includes two spare magazines being installed respectively in said first and second main bodies.

* * * * *